US005375781A

United States Patent [19]

Schwelling

[11] Patent Number: 5,375,781

[45] Date of Patent: Dec. 27, 1994

[54] PAPER SHREDDER WITH BAG FOR COLLECTING COMMINUTED MATERIAL

[76] Inventor: Hermann Schwelling, Hartmannweg 5, D-88682 Salem, Germany

[21] Appl. No.: 214,607

[22] Filed: Mar. 18, 1994

[30] Foreign Application Priority Data

Mar. 22, 1993 [DE] Germany ..... 4309103

[51] Int. Cl.[5] ..... B02C 18/40

[52] U.S. Cl. ..... 241/100; 241/236

[58] Field of Search ..... 241/100, 236, 37.5

[56] References Cited

U.S. PATENT DOCUMENTS

| | | | |
|---|---|---|---|
| 3,682,402 | 8/1972 | Goldhammer | 241/100 |
| 3,711,034 | 1/1973 | Ehinger | 241/100 |
| 4,637,560 | 1/1987 | Goldhammer | 241/100 |
| 4,650,128 | 3/1987 | Goldhammer | 241/36 |
| 4,873,811 | 10/1989 | Izumitani et al. | 53/138 A |
| 5,035,366 | 7/1991 | Hashimoto et al. | 241/36 |

FOREIGN PATENT DOCUMENTS

| | | | |
|---|---|---|---|
| 2209431 | 9/1973 | Germany | 241/100 |
| 3922313 | 1/1991 | Germany | 241/100 |
| 2187112 | 9/1987 | United Kingdom | 241/100 |

*Primary Examiner*—Mark Rosenbaum
*Assistant Examiner*—John M. Husar
*Attorney, Agent, or Firm*—Friedrich Kueffner

[57] ABSTRACT

A paper shredder includes a housing which is preferably closed to all sides and a support frame for a bag for receiving the comminuted or cut material, wherein the support frame is arranged underneath a cutting mechanism of the paper shredder and is supported on guide members arranged on inner walls of the housing so as to be movable horizontally in and out of the housing. The support frame for the bag is placed together with the bag loosely on the lateral guide rails which can be pulled out. The guide rails have stop elements at the front thereof for locking a front transverse connection of the support frame on the guide rails against sliding out horizontally, on the one hand, and to make it impossible that an outwardly directed pressure acts from the bag which is being filled onto the front housing door. In addition, the support frame for the bag for the cut material has a stirrup-shaped stop member which is mounted approximately in the middle of a frontal transverse connection thereof and which is directed toward the housing bottom.

5 Claims, 2 Drawing Sheets

PAPER SHREDDER WITH BAG FOR COLLECTING COMMINUTED MATERIAL

BACKGROUND OF THE INVENTION

1. Field of the Invention

The present invention relates to a paper shredder with a housing which is preferably closed to all sides and a support frame for a bag for receiving the comminuted material, wherein the support frame is arranged underneath a cutting mechanism of the paper shredder and is supported on guide members arranged on inner walls of the housing so as to be movable horizontally in and out of the housing.

2. Description of the Related Art

A support of this type is known, for example, from German Patent 39 22 313. In that support the support frame has guide webs arranged laterally outside of the region of the bag, wherein the guide webs extend over the inner portion of the support frame and are slidably mounted on guides arranged in the housing of the paper shredder, such that the support frame can be completely pulled out supported in the guides for replacing the bag.

This known construction is structurally very complicated. Moreover, the construction does not provide any assurance that the front portion of the housing remains securely closed and the apparatus remains tight against dust when the bag suspended from the support frame expands to all sides when it becomes full and presses against the front door of the housing as a result.

SUMMARY OF THE INVENTION

Therefore, it is the primary object of the present invention to provide a paper shredder of the above-described type in which the exchange of the bags is simplified by providing a simple and operationally safe configuration of the support frame and of the guides. In addition, the paper shredder is to include simple and reliable features for preventing the front housing door from being pressed open by the bag for collecting the cut material which expands during operation.

In accordance with the present invention, the support frame for the bag for the cut material is placed together with the bag loosely on the lateral guide rails which can be pulled out. The guide rails have stop elements at the front thereof for locking a front transverse connection of the support frame on the guide rails against sliding out horizontally, on the one hand, and to make it impossible that an outwardly directed pressure acts from the bag which is being filled onto the front housing door. In addition, the support frame for the bag for the cut material has a stirrup-shaped stop member which is mounted approximately in the middle of a frontal transverse connection thereof and which is directed toward the housing bottom.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
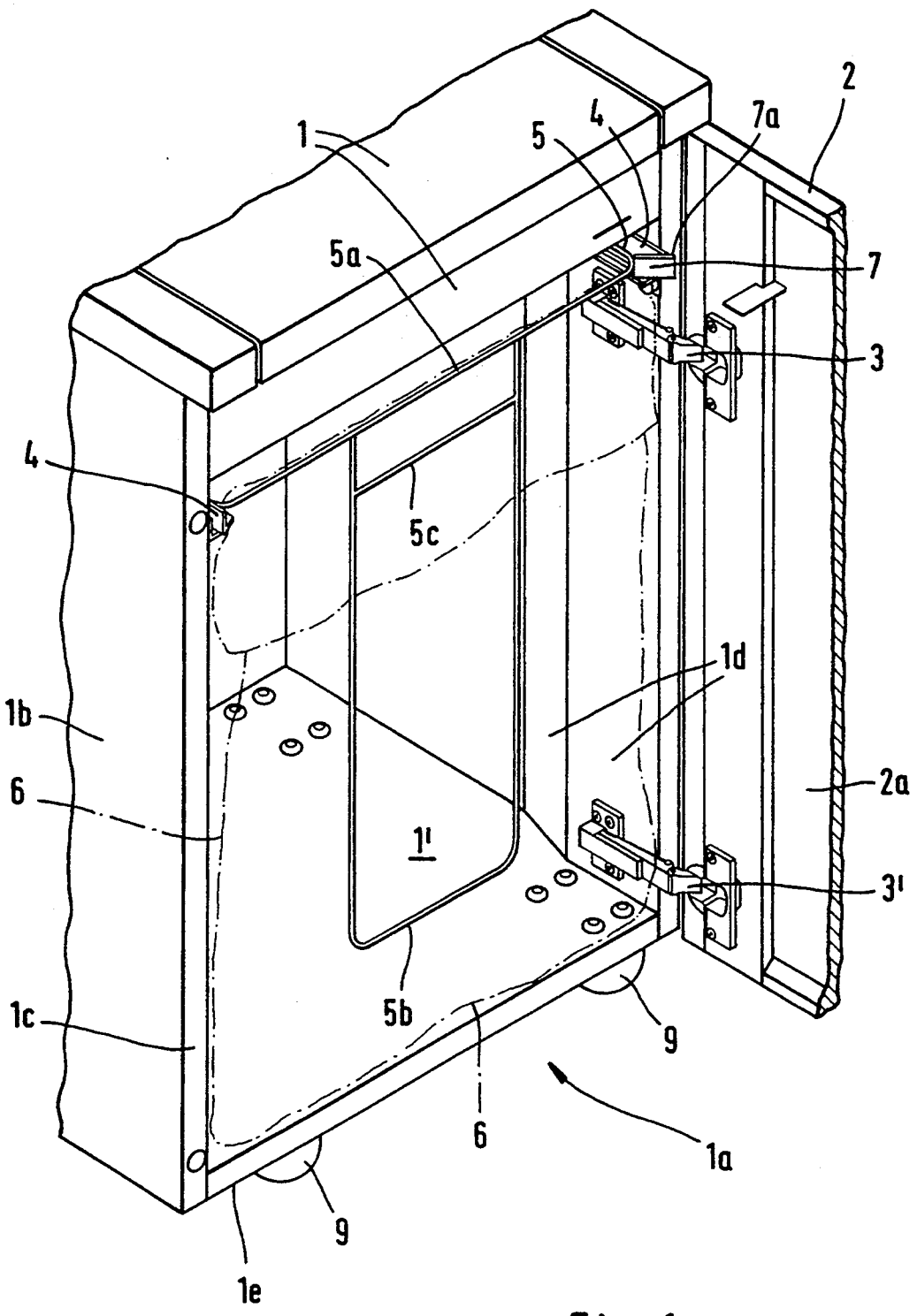
FIG. 1 is a perspective view of the front portion of a paper shredder according to the present invention, shown in the open state.
Figure 2:
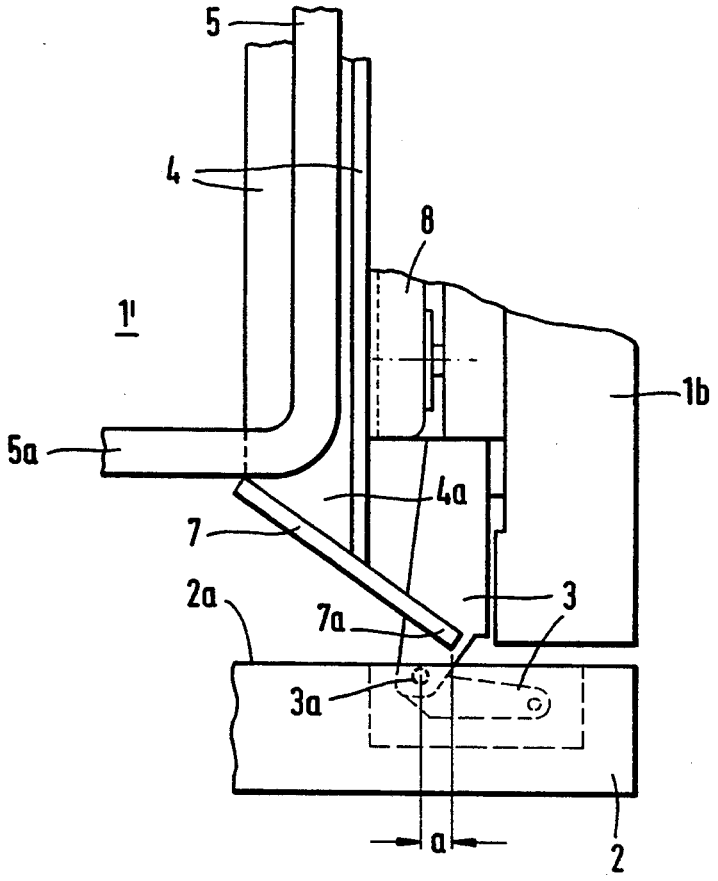
FIG. 2 is a top view of a door hinge portion of the paper shredder, shown with closed housing door.
Figure 3:
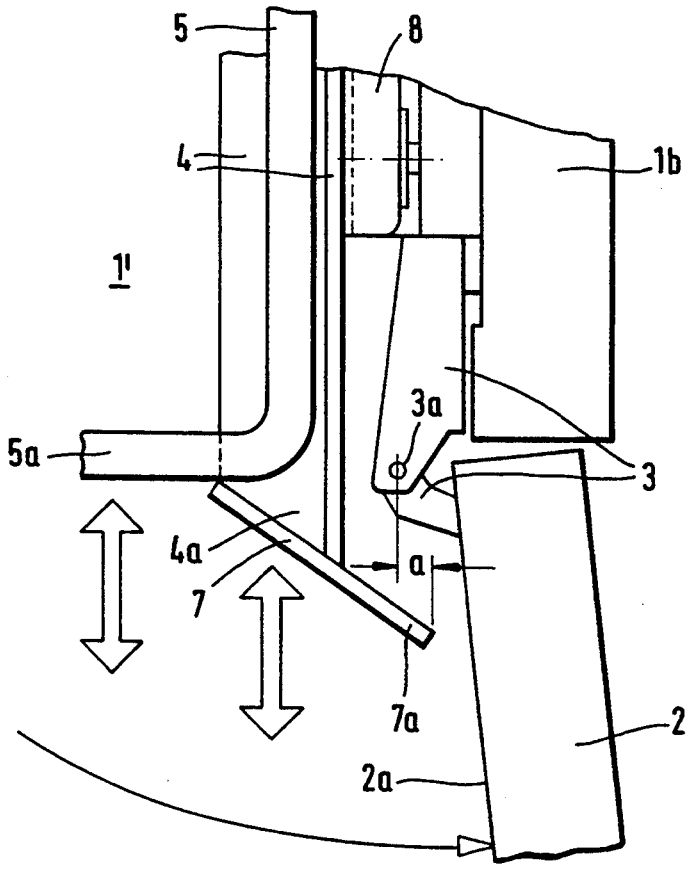
FIG. 3 is the same top view as FIG. 2, shown with open door.

FIG. 1 of the drawing is a perspective view showing the basic structure of the paper shredder according to the present invention. The paper shredder includes a housing with an upper part 1 which contains the cutting mechanism, not illustrated in detail. A lower portion of the housing is formed by housing side walls 1*b* with front edges 1*c*, by a housing bottom 1*e* and by a front housing door 2, 2*a* shown in the open position in FIG. 1. Also visible in FIG. 1 is the frontal transverse connection 5*a* of the support frame 5 for the bag 6 for collecting the comminuted or cut material. The support frame 5 can be pulled horizontally completely out of the interior 1' of the housing for emptying with its side members on angle-shaped guide rails 4 which are telescopically mounted, for example, on roller guides 8, shown in FIGS. 2 and 3, on the inner sides of the side walls 1*b* of the housing.

The novelty of the paper shredder according to the present invention resides in the combination of the following features.

a) The support frame 5, 5*a* for the bag 6 is placed together with the bag 6 loosely on the lateral support rails 4 which can be pulled out.

b) The guide rails 4 have frontal stop elements 7, 7*a* for locking the frontal transverse connection 5*a* of the support frame 5 on the guide rails 4 against Sliding out horizontally, on the one hand, and to make it impossible that an outwardly directed pressure resulting from the bag 6 which is being filled acts on the front housing door 2.

c) The support frame 5 for the bag 6 has a stirrup-shaped stop member 5*b* which is mounted approximately in the middle of the frontal transverse connection 5*a* and is directed toward the housing bottom 1*e*.

In accordance with another special feature of the invention, the guide rail 4, 4*a* located on the hinge side 3, 3*a* for the door 2 has at least one stop element 7 mounted at the front and extending transversely of the guide rail 4, 4*a*, wherein the freely projecting end 7*a* of the stop element 7 rests against the inner side 2*a* of the door 2 behind the pivoting axis 3*a* of the door hinges 3 when the front housing door 2 is closed.

In accordance with another extremely advantageous further development of the present invention, the stirrup-shaped stop member 5 is a U-shaped men, her which is closed at the bottom and which is inclined slightly inwardly toward the interior 1' of the housing 1. The support frame 5 has an additional transverse web or rod 5*c* located near and spaced below the frontal transverse connection 5*a* of the support frame 5.

Accordingly, when the bag for collecting comminuted or cut material expands as it is being filled, the initial tension of the slightly inwardly directed stirrup-shaped stop member 5*b* prevents the expanding large bag from pressing against the center portion of the front door 2 of the housing and from opening the door 2. Smaller expansions of the bag in the border regions of the door also do not cause an undesired opening of the door because the resulting forces with the lever arm a are counteracted by the holding force of the projecting free end 7*a* of the transversely extending strip-like stop element 7 of the angle-shaped guide rail 4, which holding force acts behind the door hinge or the pivoting axis 3*a* thereof on the inner side of the door.

In accordance with another useful feature, the angle-shaped guide rails 4, 4*a* including the stop element 7, 7*a* are arranged above the upper hinge 3, 3*a*, so that the guide rails 4, 4*a* and the upper hinge 3, 3*a* are arranged on different planes.

Finally, for removing the filled bag without causing damage, another feature of the present invention provides that slide plates 1*d* are arranged on both sides of the front side 1*a* of the housing on the inner surfaces of the side walls 1*b* of the housing. The slide plates 1*d* are inclined starting from the front edges 1*c* and inwardly toward the inner surfaces of the side walls of the housing.

The invention is not limited by the embodiments described above which are presented as examples only but can be modified in various ways within the scope of protection defined by the appended patent claims.

I claim:

1. A paper shredder comprising a housing having an upper portion including a cutting mechanism and a lower portion including a bottom, side walls extending upwardly from the bottom, the side walls having front edges and inner surfaces, and a front door for closing the lower portion of the housing, angle-shaped guide rails mounted on the inner surfaces of the side walls so as to be slidable horizontally out of the housing, a support frame for a bag for collecting comminuted material, the support frame having side members and a frontal transverse men, her for connecting the side members, the side members of the support frame being loosely placed on the guide rails, at least one stop element connected to a front end of one of the guide rails for preventing forward horizontal movement of the support frame on the guide rails and for preventing a forward pressure against the front door resulting from an expanding bag, the support frame further comprising a stirrup-shaped stop member directed toward the housing bottom and attached to a middle portion of the transverse men, her of the support frame.

2. The paper shredder according to claim 1, further comprising hinges connecting the front door to one of the side walls of the lower portion of the housing, the hinges defining a pivoting axis, the at least one stop element being connected to the guide rail on the side wall with the hinges, the front door having an inner side, the stop element having a projecting free end, wherein the projecting free end rests against the inner side of the door behind the pivoting axis when the front door is closed.

3. The paper shredder according to claim 2, wherein the hinges include an upper hinge and a lower hinge, the angle-shaped guide rails including the at least one stop element being mounted above the upper hinge.

4. The paper shredder according to claim 1, wherein the stop member is U-shaped and closed toward the bottom, the stop member being inclined inwardly toward an interior of the housing, the stop member further comprising an additional transverse connection mounted spaced below the frontal transverse connection.

5. The paper shredder according to claim 1, further comprising slide plates mounted on the inner surfaces of the side walls of the lower portion of the housing, the slide plates extending from the front edges and inwardly toward the inner surfaces of the side walls.

* * * * *